US005285489A

United States Patent [19]

Ohtsuchi et al.

[11] Patent Number: 5,285,489

[45] Date of Patent: Feb. 8, 1994

[54] K-EDGE FILTER AND AN X-RAY APPARATUS EMPLOYING SUCH A FILTER

[75] Inventors: Tetsuro Ohtsuchi, Osaka; Hiroshi Tsutsui, Yawata; Koichi Ohmori, Toyonaka; Sueki Baba, Suita, all of Japan

[73] Assignee: Matsushita Electric Industrial Co., Ltd., Kadoma, Japan

[21] Appl. No.: 836,427

[22] Filed: Feb. 18, 1992

[30] Foreign Application Priority Data

Feb. 20, 1991 [JP] Japan ..... 3-26110

[51] Int. Cl.[5] ..... G21K 3/00

[52] U.S. Cl. ..... 378/156; 378/158; 250/505.1

[58] Field of Search ..... 378/156, 158, 157; 250/505.1, 482.1

[56] References Cited

U.S. PATENT DOCUMENTS 4,158,769 6/1979 Smith ..... 250/505.1
4,764,946 8/1988 Teleki ..... 378/156
4,887,604 12/1989 Shefer et al. ..... 378/62
4,956,859 9/1990 Lanza et al. ..... 378/157

OTHER PUBLICATIONS

"Comparison of performance characteristics of conventional and K-edge filters in general diagnostic radiology", Nagel, 2362 Physics in Medicine & Biology, Sep. 1989, pp. 1269-1287.

"Nife-a technical advanace in non-invasive determination of total filtration of x-ray tube assemblies", Nagel, 2362 Physics in Medicine & Biology, Sep. 1990, pp. 1335-1343.

"Filter materials for dose reduction in screen-film radiography", Koedooder et al., Phys. Med. Biol., 1986, vol. 31, No. 6, pp. 585-600.

*Primary Examiner*—David P. Porta
*Assistant Examiner*—Don Wong
*Attorney, Agent, or Firm*—Wenderoth, Lind & Ponack

[57] ABSTRACT

A K-edge filter whose main portion functions as a filter member is made of a material containing at least two kinds of elements, and an X-ray apparatus is fabricated so as to include such a K-edge filter.

9 Claims, 17 Drawing Sheets

K-EDGE FILTER AND AN X-RAY APPARATUS EMPLOYING SUCH A FILTER

BACKGROUND OF THE INVENTION

The present invention relates to a K-edge filter for X-ray, which is used for obtaining predetermined spectra in X-ray apparatuses such as a medical X-ray diagnostic apparatus, a bone density measuring apparatus, a non-destructive inspection apparatus, an X-ray analyzer or the like and an X-ray apparatus employing the K-edge filter.

Generally, X-rays generated by an X-ray generator are constituted by photons having various energy levels and have an energy spectrum in which a characteristic X-ray spectrum of a steep waveform is added to gentle continuous X-ray spectrum as shown in FIG. 12. Absorption of X-rays transmitted through a substance is caused either by a phenomenon (1) in which X-rays produce a photoelectric effect in the substance so as to emit photoelectrons such that photons vanish or by a phenomenon (2) in which X-rays are partially scattered during travel of the X-rays through the substance. The absorption of X-rays caused by the phenomenon (2) exhibits a noncontinuous change (referred to as an "absorption edge") in the attenuation coefficient (absorption coefficient). The absorption edge based on K-shell electrons is referred to as a "K-absorption edge" and noncontinuous change characteristics of the attenuation coefficient are employed for an X-ray filter.

In an X-ray diagnostic apparatus, a non-destructive inspection apparatus, an X-ray analyzer or the like, it is a common practice that the X-rays used are measured by limiting the wavelength range or X-rays having a plurality of limited wavelength ranges are measured so as to be compared with one another. Meanwhile, in an apparatus for measuring a substance, for example, a bone mineral densitometry, by dividing the wavelength of the X-rays into a plurality of wavelength ranges, namely, by employing measurement results of a plurality of X-rays made monochromatic in a pseudo manner, a calculation is performed so as to effect a measurement. A K-edge filter is used as an X-ray filter for separating energy spectrum of X-rays into high and low energy regions. The K-edge filter is made of a material which not only has a K-absorption edge in a target energy region of X-rays but possesses a dependence of H's attenuation coefficient upon energy as shown in FIG. 13. The amount of X-rays which have passed through the K-edge filter changes markedly before and after the K-absorption edge, so that energy spectrum of the X-rays is separated into the two energy regions.

FIG. 14 shows an X-ray spectrum obtained after X-rays have passed through a K-edge filter made of gadolinium (Gd) and having a thickness of 100 μm. It will be seen from FIG. 14 that the energy spectrum of X-rays is separated into two energy regions at a K-absorption edge of Gd of 50.2 keV. Such conventional K-edge filters are usually made of only one element having a K-absorption edge in the X-ray region, for example, cerium (Ce), samarium (Sm) or the like.

Meanwhile, in a measuring apparatus employing a K-edge filter, an X-ray detector is usually formed by the combination of a scintillator of NaI or $GdWO_3$ and a photomultiplier tube. A K-edge filter used for the X-ray detector is made of Sm or Ce or the like.

However, the prior art arrangements referred to above have the following drawbacks. In the known K-edge filter made of a single element as shown in FIG. 14, the difference between an effective energy of the low energy region and that of the high energy region of the separated energy spectrum of the X-rays is small and the amount of X-rays becomes large in the vicinity of the boundary of the energy separation. Therefore, the energy spectrum of X-rays cannot be distinctly separated into high and low energy regions. Furthermore, since the width of the spectra of the two energy regions becomes large, a plurality of monochromatic X-rays cannot be produced in a pseudo manner. Meanwhile, if the thickness of the K-edge filter made of a single element is increased so as to clearly separate the energy spectrum of the X-ray into high and low energy regions, the number of X-ray photons passing through the K-edge filter decreases undesirably.

In an X-ray detector, the characteristic X-ray proper to the substance forming the X-ray detector is produced by an incident X-ray. When this characteristic X-ray is again absorbed into the X-ray detector, an output pulse signal accurately representing the energy of an incident X-ray can be obtained. However, if the characteristic X-ray is emitted out of the X-ray detector without being absorbed thereinto, namely, if the characteristic X-ray escapes, only a pulse signal having a pulse height smaller than that corresponding to the energy of an incident X-ray is outputted. In other words, X-rays are detected at this time as if X-rays having an energy smaller than that of the actual incident X-rays are incident upon the X-ray detector. This phenomenon is generally referred to as "characteristic X-ray escape". Output pulses having a pulse height lowered by this phenomenon are referred to as "escape peak of K-shell characteristic X-rays". The frequency of occurrence of characteristic x-ray escape depends on the volume of the X-ray detector and becomes larger the volume of the X-ray detector is reduced.

When ordinary X-rays having an energy spectrum shown in FIG. 12 is detected, the pulse height distribution of output pulses is obtained as shown by the curve a in FIG. 15. This pulse height distribution contains a pulse height component due to characteristic X-ray escape as shown by the curve b in FIG. 15. Meanwhile, also in the case where the energy spectrum of the X-rays is separated into high and low energy regions by passing X-rays through the K-edge filter and is detected, the pulse component due to the characteristic X-ray escape exists. Therefore, in the case where the energy spectrum of X-rays is separated by the K-edge filter into high and low energy regions by employing energy in the vicinity of the K-absorption edge as the boundary of the high and low energy regions so as to be measured such that the data on the numbers of photons present in the high and low energy regions are utilized, even photons having an energy of the high energy region appear as signals partially in the low energy region owing to the characteristic X-ray escape. As a result, it is impossible to obtain the accurate energy distribution of photons incident upon the X-ray detector.

For example, in an NaI scintillation detector, characteristic X-rays of about 1 keV and 28.3–33.2 keV are, respectively, produced for Na and I. In the above characteristic X-rays, especially the characteristic X-rays for I poses a problem. FIG. 16 shows results of measurement in which X-ray emitting photons of a maximum energy of 80 keV are measured by the NaI scintillation detector through its energy separation based on a K-edge filter of Ce having the K-absorption edge at 40.4 keV. The NaI scintillation detector is operated in a photon counting mode and the pulse height of output pulses of the NaI scintillation detector is proportional to the energy of incident X-ray photons. In the abscissa of FIG. 16, pulse height is converted into the energy of photons. When characteristic X-rays of I have escaped, only pulses having a pulse height corresponding to an energy 28.3–33.2 keV lower than energy of incident photons are outputted. For example, assuming that X-ray photons of 70 keV are incident upon the NaI scintillation detector and characteristic X-rays of I escape, pulses having a pulse height corresponding to an energy of 36.8–41.7 keV are outputted. An effective energy of an output peak at the side lower than a separation energy of 40.4 keV is 38 keV, while an effective energy of an output peak at the side higher than the separation energy is 74 keV. In FIG. 16, the curve b illustrates the output due to characteristic X-ray escape. As shown by the hatching in FIG. 16, an effective energy of the X-ray escape peak induced by the incident X-ray at the side higher than the separation energy is 44 keV.

When total counts of signals corresponding to an energy not less than the separation energy of 40.4 keV and the total counts of signals corresponding to energy not more than the separation energy of 40.4 keV are obtained as data, the signals shown by the hatching in FIG. 16 are produced by the incidence of photons in the high energy region separated by the K-edge filter but are measured at the sides which are both higher and lower than the separation energy based on the K-edge filter. In this example, 40% of the signals shown by the hatching in FIG. 16 are measured at the side higher than the separation energy.

By using the NaI scintillation detector, X-ray photons having a maximum energy of 100 keV are measured through the energy separation based on the K-edge filter in the same manner as described above. FIG. 17 shows results of pulse height analysis in the case of the K-edge filter made of Sm. Sm has a separation energy of 47 keV. An effective energy of the peak at the side lower than the separation energy is 45 keV, while an effective energy of the peak at the side higher than the separation energy is 80 keV. As shown by the hatching in FIG. 17, an effective energy of the escape peak of the characteristic X-rays induced by the incident X-rays at the side higher than the separation energy is 50 keV. Since the separation energy of 47 keV is smaller than the effective energy of the 50 keV of the escape peak of characteristic X-rays induced by the incident X-rays at the side higher than the separation energy, about 40% of the output pulses based on the characteristic X-ray escape appear at the side higher than the separation energy.

In the case where signals based on the characteristic X-ray escape are measured at the sides which are both higher and lower than the separation energy, this influence should be corrected. However, as the number of such signals is increased further, it becomes more difficult to correct for the influence, so that the effects of correction of the influence diminish and the measurement accuracy of the substance, etc. deteriorates.

SUMMARY OF THE INVENTION

Accordingly, an essential object of the present invention is to provide, with a view to eliminating the inconveniences of the prior art, an excellent K-edge filter capable of distinctly separating the energy spectrum into high and low energy regions and an X-ray apparatus capable of measuring the energy of X-rays accurately by using the K-edge filter.

In order to accomplish this object of the present invention, a K-edge filter according to the present invention has a main portion functioning as a filter member and made of a material containing at least two kinds of elements.

Meanwhile, an X-ray apparatus according to the present invention includes an X-ray detector and a K-edge filter, wherein a separation energy of the K-edge filter falls between a first maximum value of energy corresponding to output pulses of X-rays usable as data and a second maximum value of energy corresponding to output pulses of the X-rays obtained at the time when the K-shell characteristic X-rays generated in the X-ray detector have escaped from the X-ray detector.

Alternatively, when the energy spectrum of X-rays have been separated into high and low energy regions by the K-edge filter, a separation energy of the K-edge filter falls between a first effective energy corresponding to output pulses of the X-rays in the high energy region and a second effective energy corresponding to output pulses of the X-rays obtained at the time when the K-shell characteristic X-rays generated in the X-ray detector have escaped from the X-ray detector.

BRIEF DESCRIPTION OF THE DRAWINGS

This object and features of the present invention will become apparent from the following description taken in conjunction with the preferred embodiments thereof with reference to the accompanying drawings, in which.

DETAILED DESCRIPTION OF THE INVENTION

Figure 1:
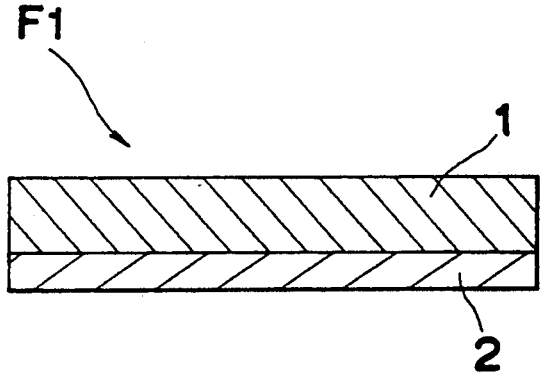
FIG. 1 is a sectional view of a K-edge filter according to a first embodiment of the present invention.

Referring now to the drawings, there is shown in FIG. 1, a K-edge filter Fl according to a first embodiment of the present invention. The filter F1 is constituted by thin plates 1 and 2 stacked on each other, which are made of gadolinium (Gd) and erbium (Er), respectively. The thin plate 1 has a K-absorption edge of 50.4 keV and is 200 μm thick. Meanwhile, the thin plate 2 has a K-absorption edge of 57.4 keV and is 100 μm thick.

Figure 2:
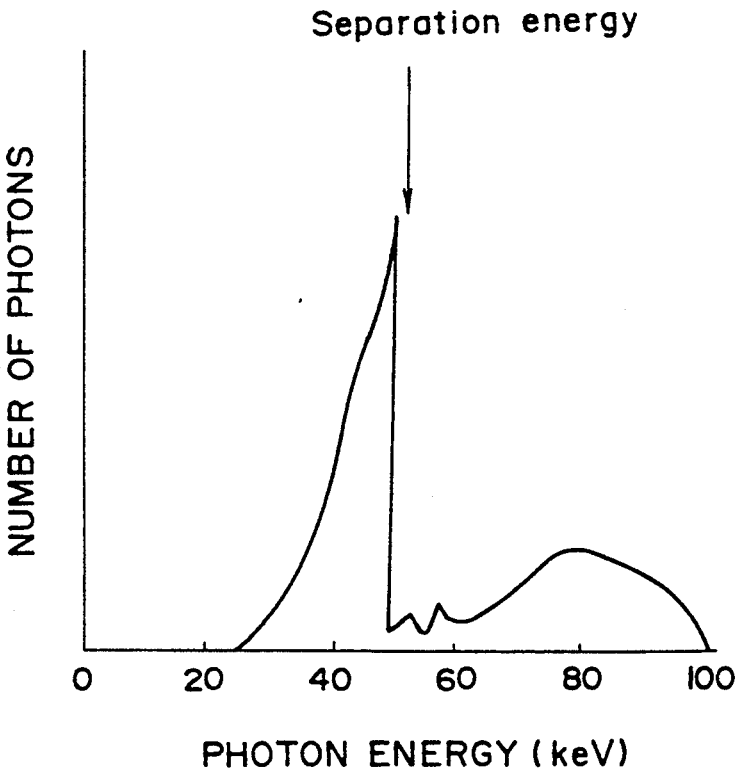
FIG. 2 is a graph showing spectrum of X-ray passed through the K-edge filter of FIG. 1.
Figure 14:
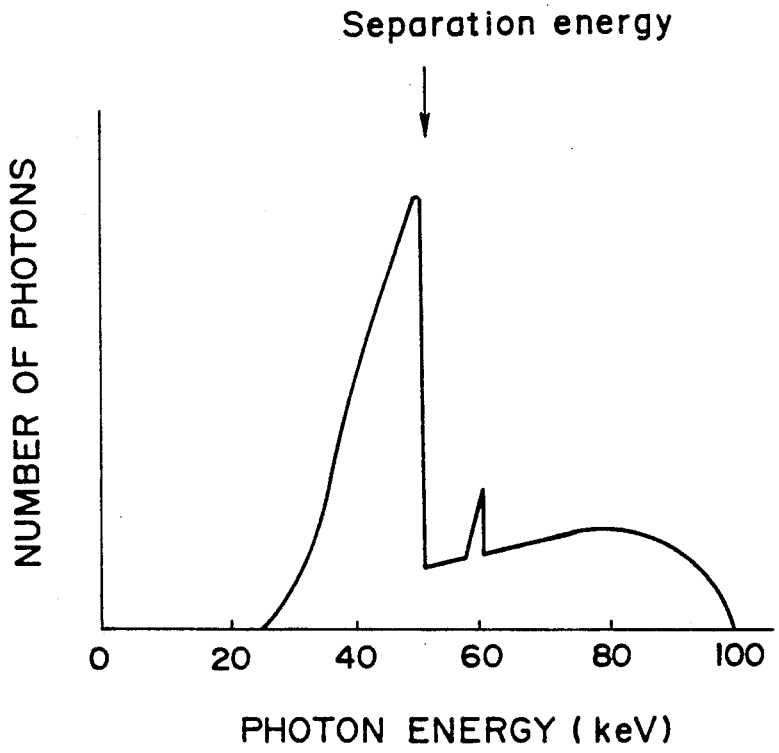
Fig. 14 PRIOR ART
FIG. 14 is a graph showing spectrum of X-ray passed through a prior art K-edge filter.
Figure 15:
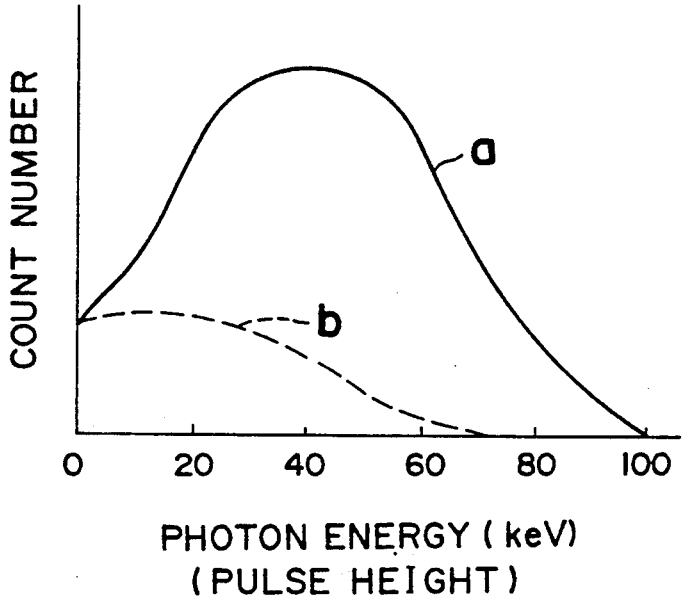
Fig. 15 PRIOR ART
FIG. 15 is a graph showing output spectrum of characteristic X-ray escape.
Figure 16:
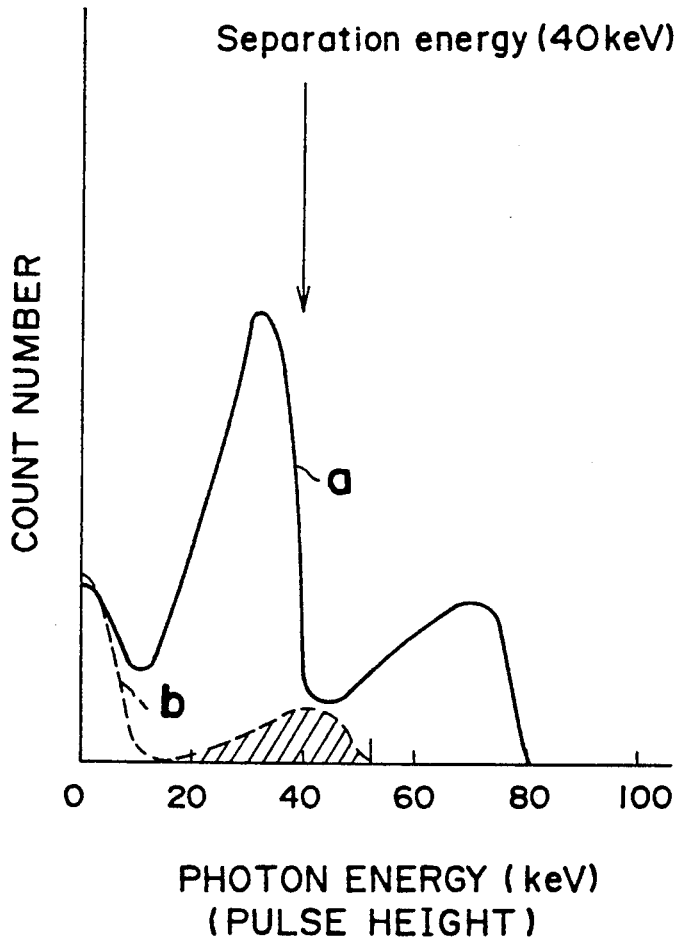
Fig. 16 PRIOR ART
FIG. 16 is a graph showing output spectrum of an X-ray detector in the case of use of a prior art K-edge filter.
Figure 17:
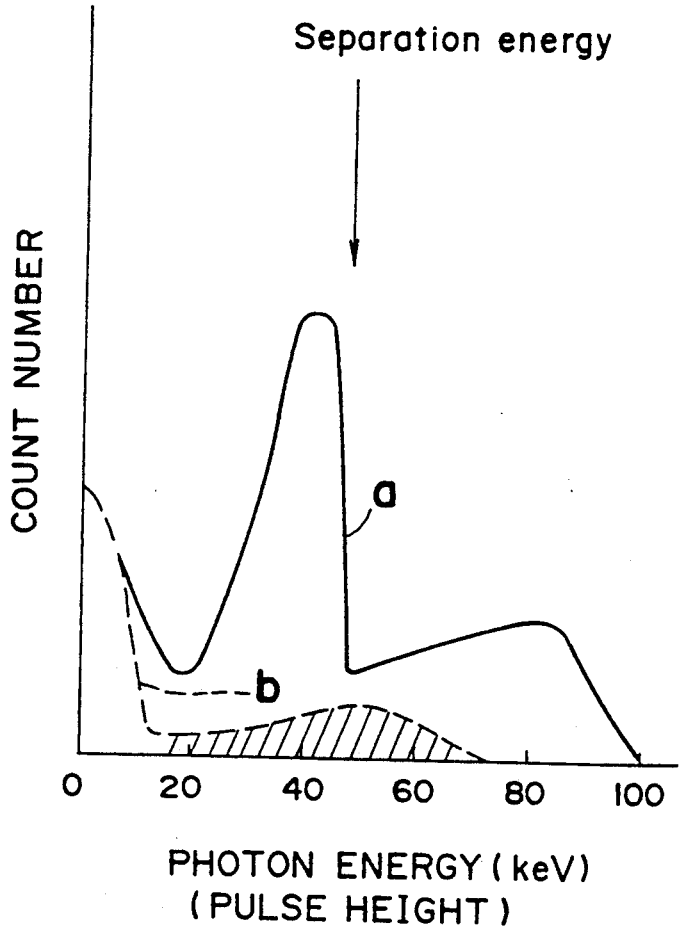
Fig. 17 PRIOR ART
FIG. 17 is a graph showing another output spectrum of an X-ray detector in the case of use of another prior art K-edge filter.

FIG. 2 shows the spectrum of X-rays which have been passed through the filter F1 upon irradiation of X-rays thereto. As compared with FIG. 14 showing spectrum of X-ray passed through a known K-edge filter, it is apparent that the energy spectrum of the X-rays is separated into high and low energy regions more distinctly and the amount of X-rays transmitted through the K-edge filter at a boundary between the high and low energy regions is reduced over a wider energy range. Therefore, the boundary between the high and low energy regions can be selected from a wider energy range than that of FIG. 14.

Meanwhile, in FIG. 2, although rise of the low energy region is more steep and the spectrum width of the low energy range is made narrower, the amount of X-rays transmitted through the K-edge filter is substantially the same as that of FIG. 14. The elements used for the filter F1 are preferably combined with each other such that there is a difference of 5–10 keV in K-absorption edges between the elements. In place of the thin plates 1 and 2, the filter Fl may be obtained by growing thin films of Gd, Er, etc. by sputtering on a substrate made of an element having a relatively low atomic number, for example, glass. In order to grow the thin films, sputtering may be replaced by vacuum evaporation, chemical vapor deposition (CVD) or plasma CVD.

Figure 3:
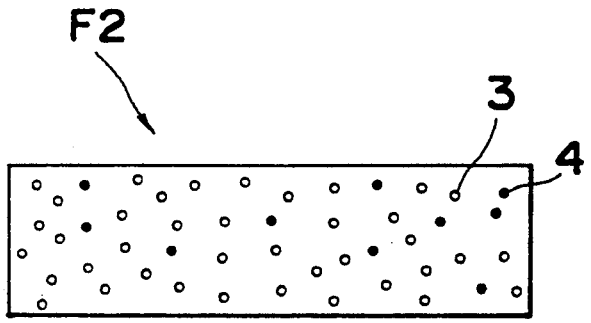
FIG. 3 is a sectional view of a K-edge filter according to a second embodiment of the present invention.
Figure 4:
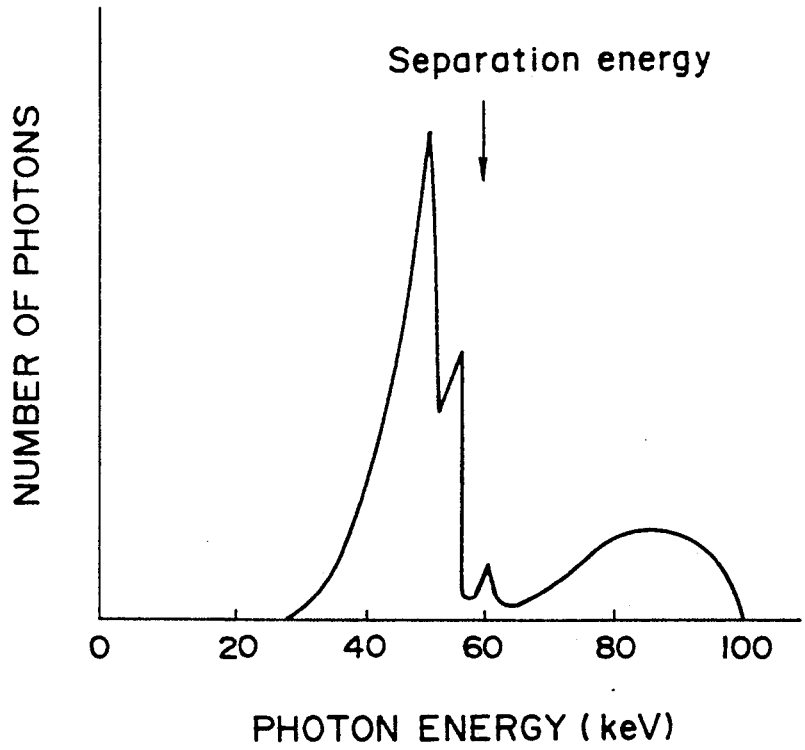
FIG. 4 is a graph showing spectrum of X-ray passed through the K-edge filter of FIG. 3.

FIG. 3 shows a K-edge filter F2 according to a second embodiment of the present invention. In the filter F2, Gd powder 3 and Er powder 4 are uniformly mixed into epoxy resin so as to correspond to a thickness of 100 μm per unit area and a thickness of 300 μm per unit area, respectively. FIG. 4 shows spectrum of X-rays which have been passed through the filter F2. It will be seen from FIG. 4 that by employing the two elements each having a K-absorption edge in the energy region of the target X-rays, the energy separation of the energy spectrum of the X-rays can be performed distinctly.

Figure 5:
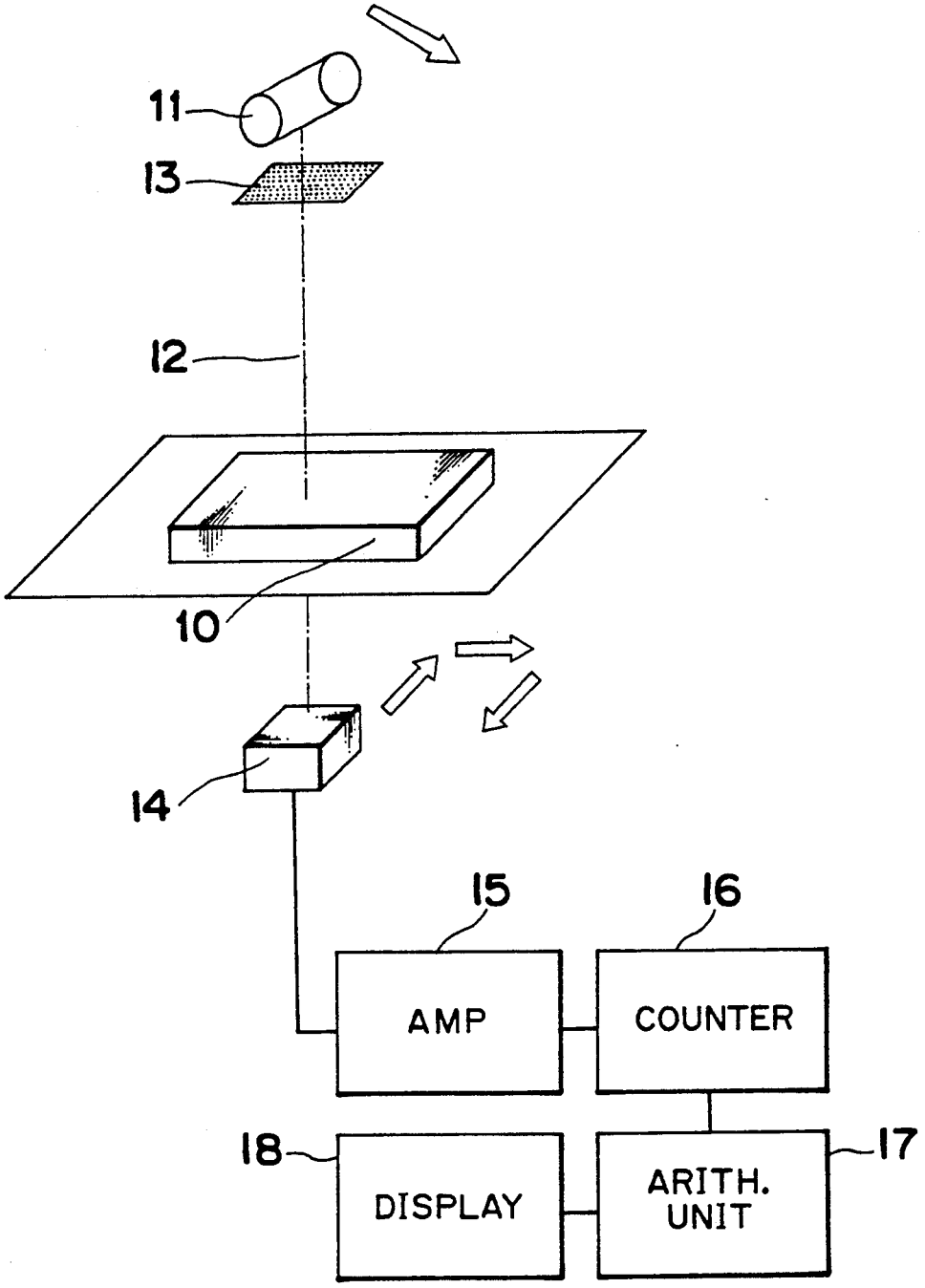
FIG. 5 is a schematic view of an X-ray apparatus according to a third embodiment of the present invention.

FIG. 5 shows an X-ray apparatus according to a third embodiment of the present invention. The X-ray apparatus includes an X-ray generator 11 for emitting pencil-beam X-rays 12, a K-edge filter 13, a CdTe X-ray detector 14 employing cadmium (Cd) and tellurium (Te), an amplifier 15, a counter 16, an arithmetic unit 17 and a display unit 18. In this X-rays apparatus, the X-ray 12 are subjected to energy separation into high and low energy regions by the K-edge filter 13 and the count numbers of photons in the high and low energy regions are measured by the CdTe X-ray detector 14 such that a quantitative analysis of a sample 10 to be measured is performed. In FIG. 5, the pencil-beam X-rays 12 are irradiated over the sample 10 from the X-ray generator 11 through the K-edge filter 13 and X-ray photons transmitted through the sample 10 are converted into electric pulses by the CdTe X-ray detector 14. Then, the electric pulses are amplified by the amplifier 15 so as to be counted by the counter 16. By scanning the X-ray generator 11 and the CdTe X-ray detector 14 synchronously with each other, it is possible to perform two-dimensional measurement of the sample 10. Meanwhile, images of X-ray transmitted through the sample or calculation results obtained by calculating measured data by the arithmetic unit 17 can be displayed on the display unit 18.

Figure 6:
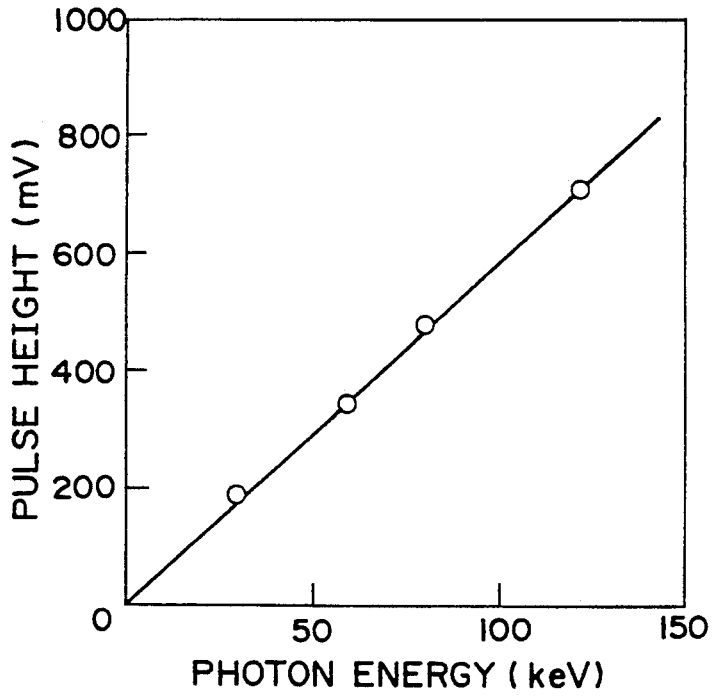
FIG. 6 is a graph showing relating between pulse height of output of the X-ray apparatus of FIG. 5 and energy of incident X-ray.

The CdTe X-rays detector 14 is operated in photon counting mode. As shown in FIG. 6, the CdTe X-ray detector 14 outputs pulses having a pulse height proportional to the energy of incident X-ray photons. The spectrum of incident X-rays can be obtained by measuring the pulse height distribution of output pulses of the CdTe X-ray detector 14. The number of photons having an energy larger than a separation energy can be obtained by measuring pulses having pulse a height larger than that corresponding to the separation energy. On the contrary, the number of photons having an energy smaller than the separation energy can be obtained by measuring pulses having a pulse height smaller than that corresponding to the separation energy.

In the CdTe X-ray detector 14, characteristic X-rays having an energy of 28.0 to 32.5 keV are generated from each of Cd and Te. Therefore, in X-ray photons irradiated from the X-ray generator 11, output pulses due to the characteristic X-ray escape appear at a side in pulse height distribution whose energy is lower than an energy obtained by subtracting 28 keV from a maximum value of energy usable as data. The K-edge filter 13 includes a plate made of Gd and having a thickness of 300 μm and a plate made of Er and having a thickness of 100 μm.

Figure 7:
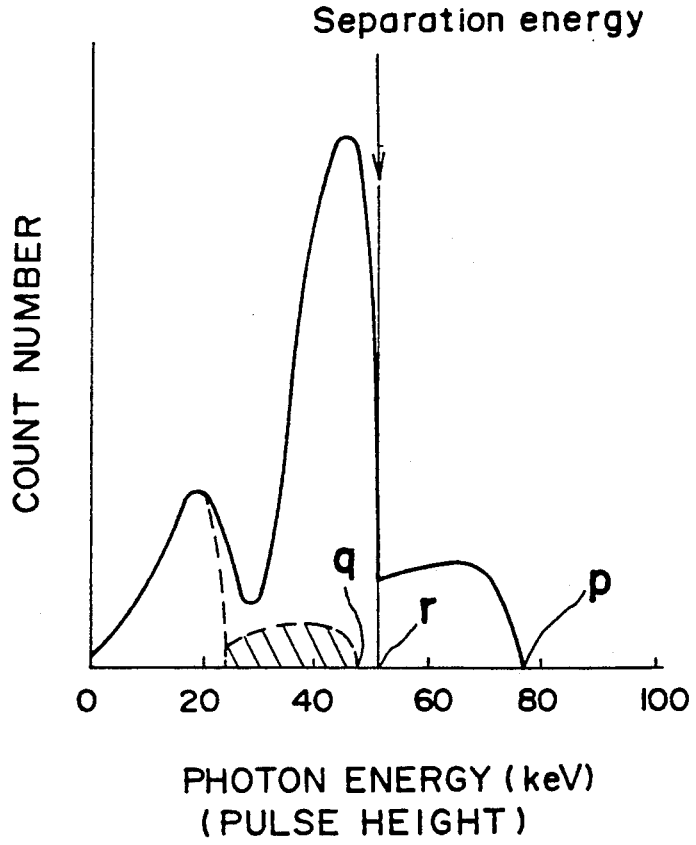
FIG. 7 is a graph showing output spectrum of a CdTe X-ray detector employed in the X-ray apparatus of FIG. 5.

FIG. 7 shows pulse height distribution of output pulses obtained in the case where X-rays having been subjected to energy separation by the K-edge filter 13 are measured by the CdTe X-ray detector 14. As shown in FIG. 2, the separation energy is located between 50 and 60 keV. In this embodiment, the separation energy is set at 55 keV as shown by the point r. By using a pulse height corresponding to 55 keV as a boundary, the sum of photons having pulse height lower than the boundary and the sum of photons having pulse height higher than the boundary are counted such that a quantitative analysis, etc. of the sample 10 is performed based on the counted results. The maximum energy of photons usable as data is 75 keV as indicated by the point p. In FIG. 7, the portions shown by broken lines illustrate output pulses due to the characteristic X-ray escape. A maximum energy q of output pulses due to the characteristic X-ray peak is 47 keV (=75−28). Therefore, the separation energy r of 55 keV falls between the maximum energy q of 47 keV of output pulses due to the characteristic X-ray escape and the maximum energy p of 75 keV of photons usable as data.

As will be seen from FIG. 7, output pulses due to the characteristic X-ray escape generated by photons belonging to the high energy region shown by the hatching are all included in output pulses having an energy lower than the separation energy when counting the number of photons. Therefore, assuming that character A denotes the probability of occurrence of the characteristic X-ray escape and character CH denotes the count number of photons in the high energy region, as measured by the CdTe X-ray detector 14 and character CRH denotes the count number of photons in the high energy region actually incident upon the CdTe X-ray detector 14, then the count number CRH can be obtained easily by the following equation.

$$CRH = CH/(1-A)$$

Meanwhile, supposing that character CL denotes the count number of photons in the low energy region, as measured by the CdTe X-ray detector 14 and character CRL denotes the count number of photons in the low energy region actually incident upon the CdTe X-ray detector 14, then the count number CRL is given by the following equation.

$$CRL = CL - CRH \times A/(1-A)$$

Figure 8:
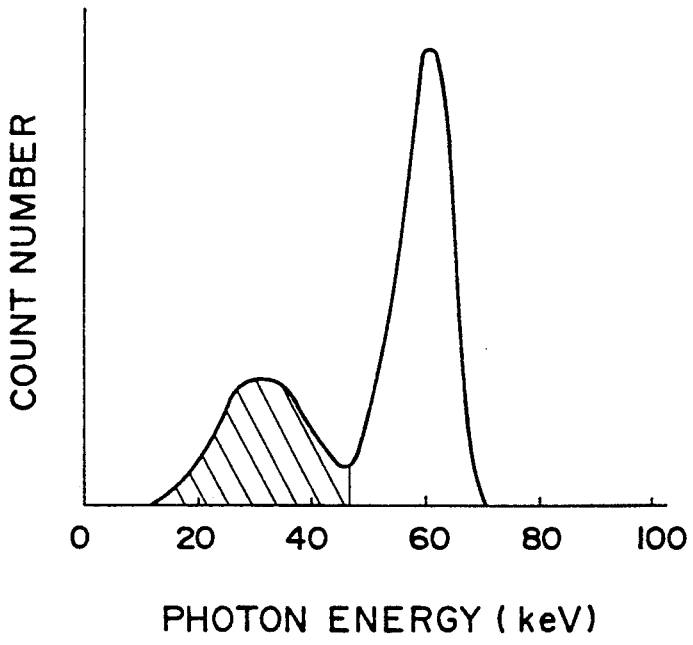
FIG. 8 is a graph showing output spectrum of the CdTe X-ray detector of FIG. 7 at the time of irradiation of $\gamma$-ray thereto.

By considering combination of the energy of the characteristic X-ray escape of the CdTe X-ray detector 14 and the K-edge filter 13, X-rays can be measured easily and accurately. The same effect as described above can be achieved by variously combining such elements as terbium (Tb), dysprosium, holmium (Ho), thulium (Tm), ytterbium (Yb), etc. The probability A can be in advance outlined from such energy spectrum as shown in FIG. 8 by irradiating mononergetic $\gamma$-rays by the use of $^{241}$Am (americium). In FIG. 8, the probability A represents the ratio of the hatching portion to the total count number of photons.

In the case where a maximum energy of X-rays to be measured is 120 keV, the energy separation may be performed in the vicinity of 90 keV. At this time, lead (Pb) and polonium (Po) may be combined in the K-edge filter 13. Alternatively, radon (Rn), francium (Fr), thallium (T1), polonium (Po), bismuth (Bi), etc. may be combined in the K-edge filter 13.

Meanwhile, in the case of a CdSe X-ray detector employing cadmium (Cd) and selenium (Se) or a CdS X-ray detector employing cadmium (Cd) and sulfur (S), since the characteristic X-rays are generated mainly from Cd, an accurate measurement of X-ray can be performed by using the K-edge filter 13 made of Gd and Er.

Figure 9:
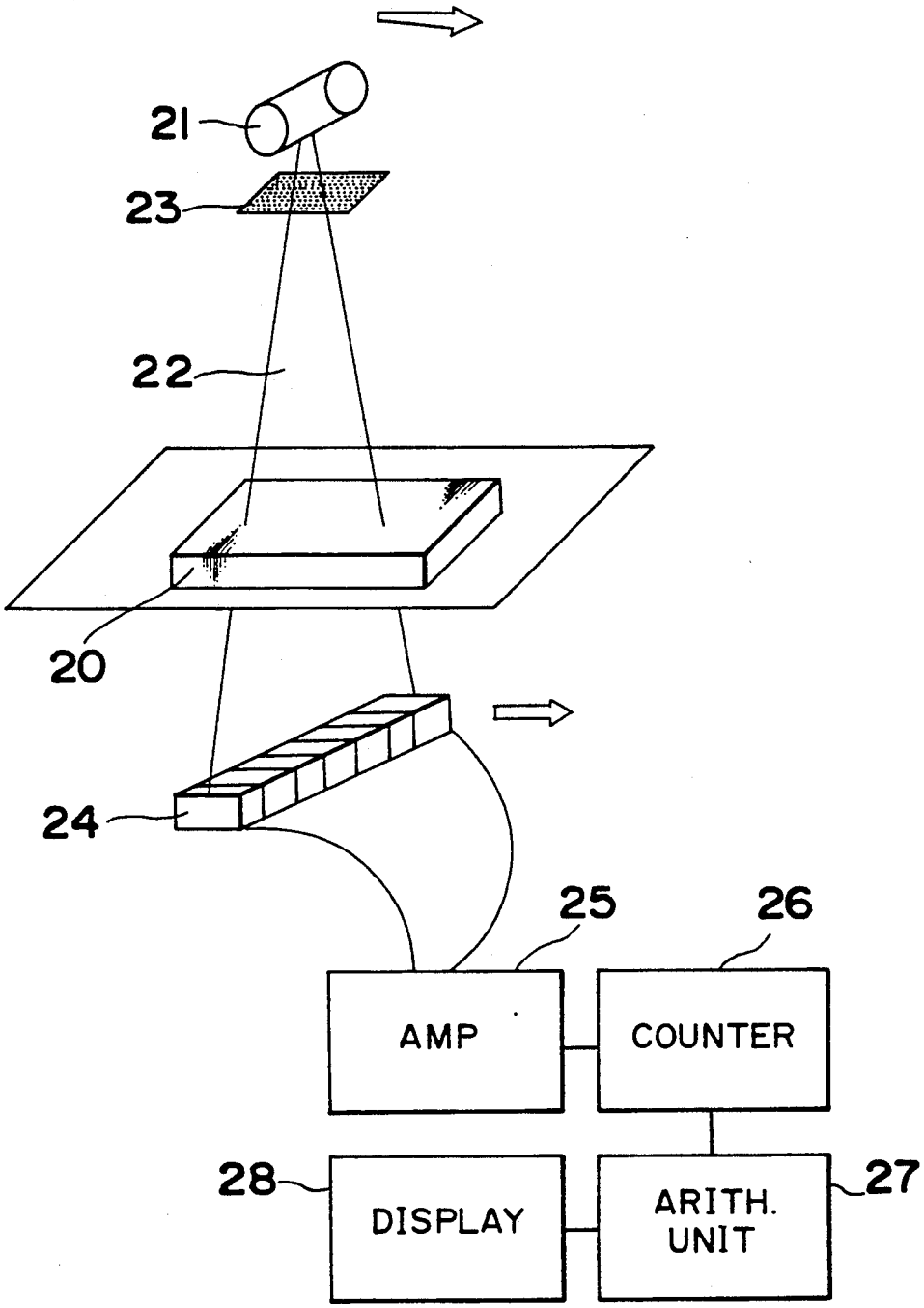
FIG. 9 is a schematic view of an X-ray apparatus according to a fourth embodiment of the present invention.

FIG. 9 shows an X-ray apparatus according to a fourth embodiment of the present invention. the X-ray apparatus includes an X-ray generator 21 for emitting fan-beam X-rays 22, a K-edge filter 23, a multichannel type CdTe X-ray detector 24, an amplifier 25, a counter 26, an arithmetic unit 27 and a display unit 28. By scanning the CdTe X-ray detector 24 synchronously with the X-ray generator 21, the number of X-ray photons transmitted through a sample 20 to be measured can be counted in a two-dimensional area. Each channel of the CdTe X-ray detector 24 in this embodiment includes an amplifier 25 and a counter 26. The CdTe X-ray detector 24 is operated in a photon counting mode and outputs pulses having a pulse height proportional to energy of the incident X-ray photons. In the case of the multichannel type CdTe X-ray detector 24, the size of each detection element is reduced. As a result, the quantity of X-rays absorbed by each detection element is reduced and the count number of pulses outputted by each detection element decreases and the characteristic X-ray escape is apt to take place.

In the case where quantitative analysis of the sample 20 is performed, the measuring accuracy is raised as the count number of pulses is increased. To this end, a maximum energy of the X-ray photons to be emitted is raised such that the count number of X-ray photons in the high energy region is increased. In this embodiment, the maximum energy of X-ray photons to be emitted is 100 keV and the K-edge filter 23 includes a Gd plate having a thickness of 200 $\mu$m and an Er plate having a thickness of 100 $\mu$m.

Figure 10:
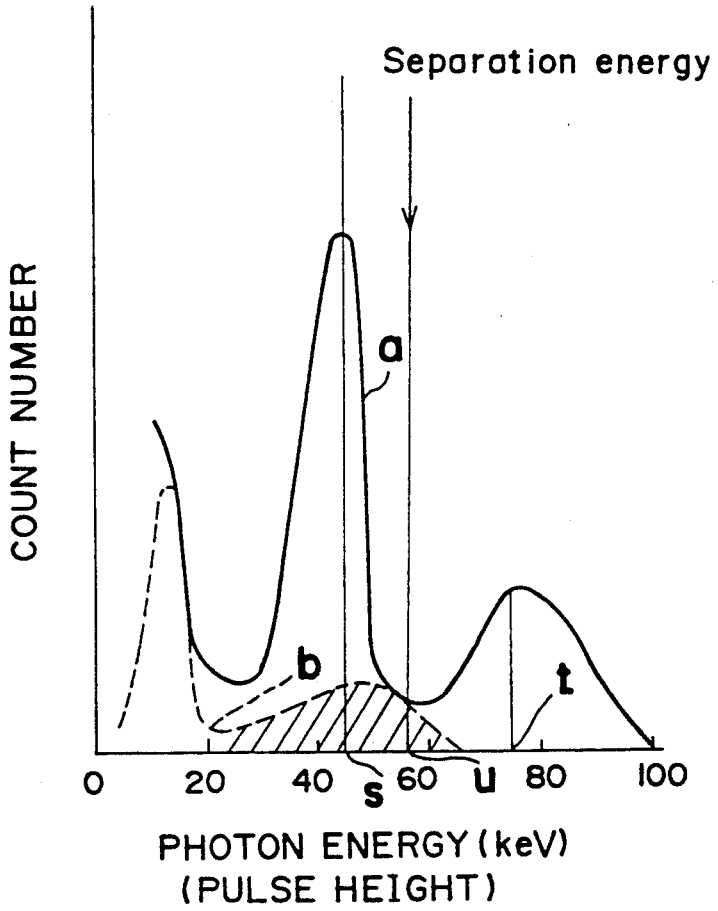
FIG. 10 is a graph showing output spectrum of a CdTe X-ray detector employed in the X-ray apparatus of FIG. 9.

FIG. 10 shows pulse height distribution of output pulses of each detection element of the CdTe X-ray detector 24. The pulse height of output pulses of each detection element is proportional to the energy of photons incident upon the detection element. In the abscissa of FIG. 10, the pulse height is converted into the energy of photons. The output pulses due to characteristic X-ray escape generated by incident photons in the high energy region appear in an area having a pulse height smaller than that corresponding to 72 keV as shown by the hatching in FIG. 10. As shown by the point s, an effective energy of this characteristic X-ray escape peak induced by the incident X-rays at the side higher region is about 45 keV.

An effective energy of the output peak at a side having an energy lower than the separation energy of the X-rays which have passed through the K-edge filter 23 is 45 keV, while an effective energy of the output peak at a side higher than the separation energy of X-rays which have passed through the K-edge filter 23 is 75 keV as shown by the point t.

As shown in FIG. 2, the quantity of X-rays which have passed through the K-edge filter 23 drops in the vicinity of 50–60 keV and thus, the separation energy is located between 50 and 60 keV. Thus, the separation energy can be selected in the range of 50 to 60 keV. In order to lessen the influence of the characteristic X-ray escape, the separation energyis set at 57 keV as shown by the point u so as to fall between the effective energy t of 75 keV of output peak at the high energy side and the effective energy s of the 45 keV of characteristic X-ray escape peak. By using the pulse height corresponding to the separation energy u of 57 keV as a boundary, the number of pulses in the low energy region and the number of pulses in the high energy region are counted so as to be calculated. As will be seen from FIG. 10, most of the pulse height components of the characteristic X-ray escape appear at the side having an energy lower than the separation energy. In this embodiment, since 96% of the characteristic X-ray escape is counted at the side having an energy lower than the separation energy, the correction of the influence of the characteristic X-ray escape can be accurately performed.

Assuming that character A' denotes the possibility of the occurrence of the characteristic X-ray escape, and character CL denotes the number of output pulses having a low energy, and character CH denotes the number of output pulses having a high energy, and character CRL denotes the number of low-energy X-ray photons incident upon the CdTe X-ray detector 24 and character CRH denotes the number of high-energy X-ray photons incident upon the CdTe X-ray detector 24, then the numbers CRH and CRL are expressed as follows.

$$CRH = CH/(1-A')$$

$$CRL = CL - CRH \times A'/(1-A')$$

Also by this correction, the accuracy of quantitative analysis can be obtained sufficiently.

In this embodiment, since the K-edge filter is arranged such that the separation energy falls between the effective energy of the output peak at the side having a high energy and the effective energy of the characteristic X-ray escape peak as described above, the influence of the characteristic X-ray escape can be lessened and thus, quite a high measuring accuracy can be obtained.

If the CdTe X-ray detector 24 is replaced by a CdS X-ray detector, the K-shell characteristic X-rays of S is as small as about 2.3 keV. Thus, the characteristic X-ray escape of S is least likely to take place. Therefore, in this case, only the characteristic X-ray escape peak of Cd may be taken into consideration and the K-edge filter 23 made of Gd and Er can also be used.

Figure 11:
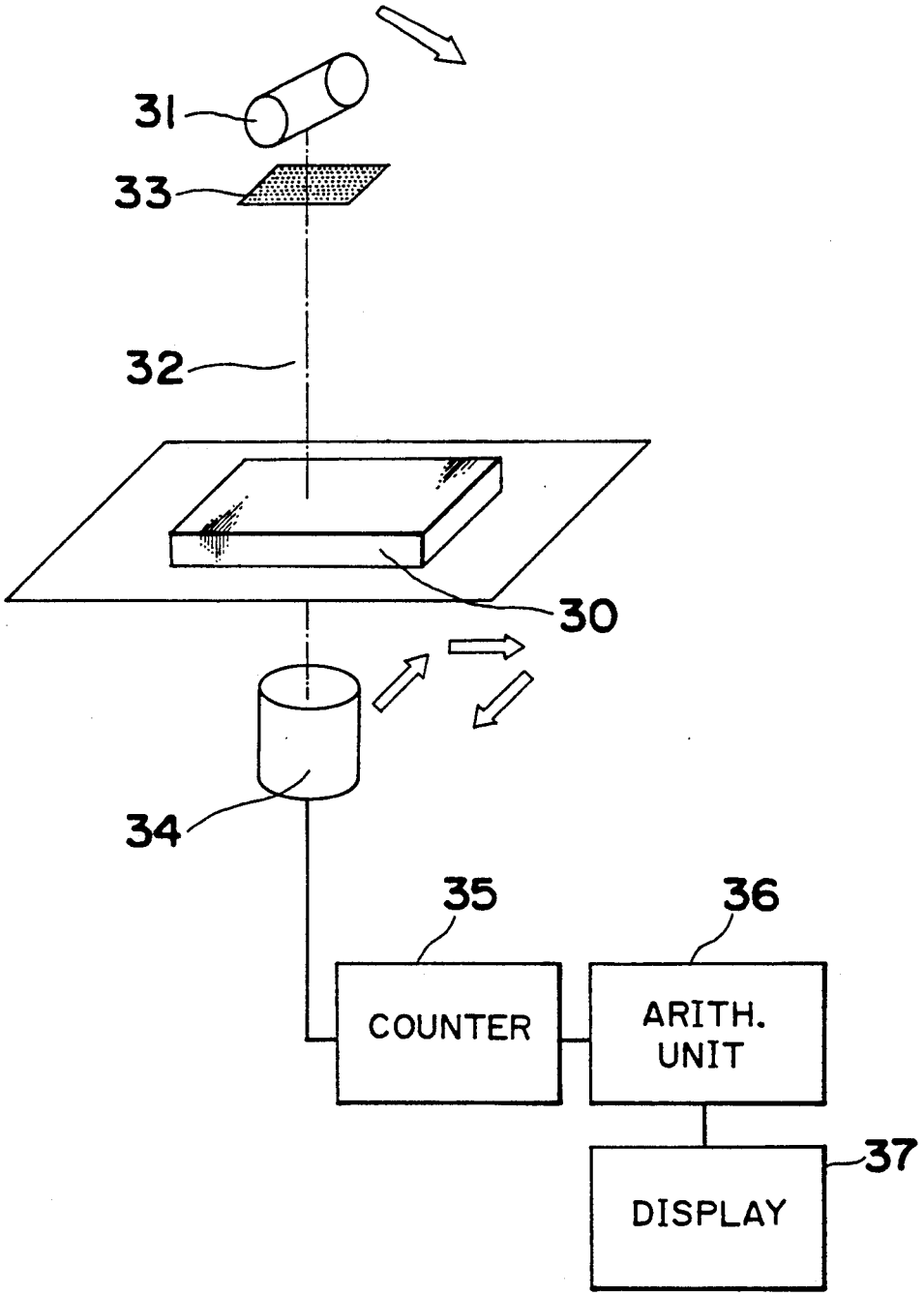
FIG. 11 is a schematic view of an X-ray apparatus according to a fifth embodiment of the present invention.
Figure 12:
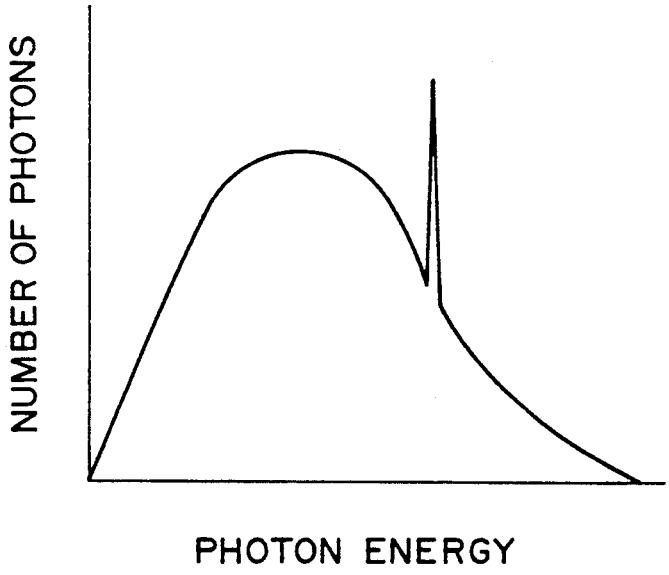
Fig. 12 PRIOR ART
FIG. 12 is a graph showing spectrum of X-ray generated by a known X-ray generator.
Figure 13:
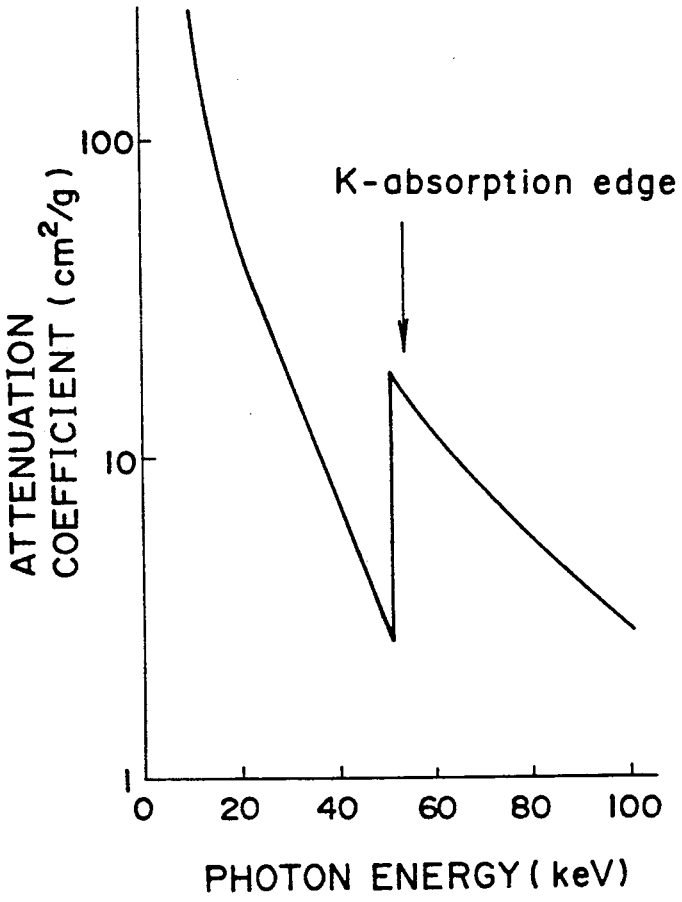
Fig. 13 PRIOR ART
FIG. 13 is a graph showing X-ray attenuation coefficient of a prior art K-edge filter.

FIG. 11 shows an X-ray apparatus according to a fifth embodiment of the present invention. The X-ray apparatus includes an X-rays generator 31 for emitting X-ray 32, a K-edge filter 33, an NaI scintillation detector 34 acting as an X-ray detector, a counter 35, an arithmetic unit 36 and a display unit 37. The NaI scintillation detector 34 may be replaced by a $GdWO_3$ scintillation detector. In the X-rays apparatus, the X-ray 32 generated by the X-ray generator 31 are irradiated, through the K-edge filter 33, over a sample 30 to be measured. Then, X-ray photons transmitted through the sample 30 are measured by the NaI scintillation detector 34. The NaI scintillation detector 34 outputs pulses having a pulse height proportional to the energy of the incident X-ray photons. The output pulses of the scintillation detector 34 are counted by the counter 35 and the count numbers of the counter 35 are calculated by the arithmetic unit 36 such that the calculation results of the arithmetic unit 36 are displayed on the display unit 37.

In the case where X-ray photons having a maximum energy of 80 keV are measured through energy separation, the signals due to characteristic X-ray escape of I appear from about 50 keV in the low energy region. Therefore, a combination of elements having a K-absorption edge of not less than 50 keV should be employed for the K-edge filter 33. For example, in the case of the combination of terbium (Tb), holmium (Ho) and erbium (Er), an energy separation can be obtained in the vicinity of 56 keV. Therefore, the in this embodiment, combination of Tb, Ho and Er is employed for the K-edge filter 33. In addition to this combination, the combinations of samarium (Sm), europium (Eu), gadolinium (Gd), terbium (Tb), dysprosium (Dy), holmium (Ho), erbium (Er), ytterbium (Yb), lutetium (Lu), hafnium (Hf), tantalum (Ta), etc. may be employed.

Meanwhile, in the case where X-ray photons having a maximum energy of 100 keV are measured through energy separation, Gd and Er may be combined in the K-edge filter 33 as in the fourth embodiment. At this time, since band of energy separation is widened, the separation energy can be set between the output peak in the high energy region and the effective energy of the characteristic X-ray escape peak due to photons in the high energy region, so that correction of the influence of the characteristic X-ray escape can be performed.

Also in the case where an $HgI_2$ X-ray detector based on mercury (Hg) and iodine (I) is employed, the characteristic X-rays of I poses a problem. Since the characteristic X-rays of Hg range from 68.9 to 82.6 keV, the characteristic X-ray escape does not offer a serious problem in the case of X-rays of about 100 keV or less. Therefore, a K-edge filter having the same combination of elements as that of the K-edge filter 33 applied to the NaI scintillation detector 34 can be employed.

As is clear from the foregoing description, the K-edge filter employing two kinds of absorption materials is excellent in energy separation of X-rays in the present invention. Therefore, by selecting the combination of the K-edge filter and the X-ray detector in view of the energy of the characteristic X-rays generated by the K-edge filter and the X-ray detector and the high and low energy regions into which the energy of X-rays has been separated by the K-edge filter, the numbers of photons of X-ray incident upon the X-ray detector can be measured accurately for the high and low energy regions, respectively.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A K-edge filter through which X-rays are passed so as to be subjected to energy separation into two energy regions, said K-edge filter including a main portion functioning as a filter member;

said main portion having an effective thickness of at least 100 μm;

said K-edge filter being made of a material containing at least two kinds of elements whose K-absorption edges are different from each other in a range of from 5 to 10 keV.

2. A K-edge filter as claimed in claim 1, wherein atomic numbers of the elements are in a range from 50 to 85.

3. A K-edge filter as claimed in claim 1, wherein said main portion is formed of at least two thin plates or at least two thin films, which are stacked on each other and are made of the elements, respectively.

4. A K-edge filter as claimed in claim 1, wherein said main portion is made of at least two powder materials of the elements;

said powder materials being mixed with each other so as to be fixed in position in said main portion.

5. An X-ray apparatus comprising:

an X-ray generator;

a CdTe X-ray detector; and a K-edge filter through which X-rays are passed so as to be subjected to energy separation into two energy regions;

said K-edge filter including a main portion functioning as a filter member;

said main portion having an effective thickness of at least 100 μm;

said K-edge filter being made of a material containing at least two kinds of elements whose K-absorption edges are different from each other in a range of from 5 to 10 keV.

6. An X-ray apparatus comprising:

an X-ray generator;

a multichannel type CdTe X-ray detector; and a K-edge filter through which X-rays are passed so as to be subjected to energy separation into two energy regions;

said K-edge filter including a main portion functioning as a filter member;

said main portion having an effective thickness of at least 100 μm;

said Kedge filter being made of a material containing at least two kinds of elements whose K-absorption edges are different from each other in a range of from 5 to 10 keV.

7. An X-ray apparatus comprising:

an X-ray generator;

an X-ray detector; and a K-edge filter through which X-rays are passed so as to be subjected to energy separation into two energy regions;

said K-edge filter including a main portion functioning as a filter member;

said main portion having an effective thickness of at least 100 μm;

said K-edge filter being made of a material containing at least two kinds of elements whose K-absorption edges are different from each other in a range of from 5 to 10 keV.

8. An X-ray apparatus as claimed in claim 7, wherein said X-ray detector is a CdS X-ray detector.

9. An X-ray apparatus as claimed in claim 7, wherein said X-ray detector is one of an NaI scintillation detector, a $GdWO_3$ scintillation detector and an $HgI_2$ X-ray detector.

* * * * *